US010806284B1

(12) United States Patent
Donegan

(10) Patent No.: US 10,806,284 B1
(45) **Date of Patent: *Oct. 20, 2020**

(54) HANGER SPACER TAPE

(71) Applicant: Stephen P. Donegan, Los Angeles, CA (US)

(72) Inventor: Stephen P. Donegan, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/382,153

(22) Filed: Apr. 11, 2019

Related U.S. Application Data

(63) Continuation of application No. 16/051,438, filed on Jul. 31, 2018, now Pat. No. 10,299,615.

(51) Int. Cl.
*A47G 25/14* (2006.01)
*A47G 25/06* (2006.01)

(52) U.S. Cl.
CPC ..... *A47G 25/1471* (2013.01); *A47G 25/0692* (2013.01); *A47G 25/06* (2013.01); *A47G 25/145* (2013.01)

(58) Field of Classification Search
CPC ..... A47G 25/1442; A47G 25/145; A47G 25/1471; A47G 25/26; A47G 25/0692; A47G 25/06
USPC ..... 211/30–33, 124, 105.1, 85.3, 123; 223/87, 88, 85, 98
See application file for complete search history.

(56) References Cited

U.S. PATENT DOCUMENTS 429,965 A * 6/1890 Sayers ..... B65D 85/185 211/124
586,080 A * 7/1897 Thompson ..... A47K 10/04 211/123
1,165,108 A * 12/1915 Memmler ..... A47G 25/0692 211/124
D67,680 S * 6/1925 Ziegler ..... 211/33
1,969,958 A * 8/1934 Alder ..... A47K 3/003 16/DIG. 2
2,063,585 A * 12/1936 Comstock ..... A47K 10/04 211/123
2,094,529 A * 9/1937 Fisher ..... B44C 5/02 211/105.1
2,094,810 A * 10/1937 Oppenheimer ..... A47F 7/06 211/166
2,103,642 A * 12/1937 Roller ..... A47B 61/003 211/85.3
2,335,030 A * 11/1943 Rotheraine ..... A47B 61/003 211/105.3
D137,325 S * 2/1944 Portis ..... 211/30
D149,919 S * 6/1948 Ullmann ..... 211/85.3
2,585,715 A * 2/1952 Youngblood ..... A47G 25/26 223/98
2,663,530 A * 12/1953 Nye ..... A47G 25/0692 116/DIG. 24
2,740,531 A * 4/1956 Simpkins ..... A47B 61/02 211/85.3
2,868,389 A * 1/1959 Friend ..... A47G 25/1471 211/123

(Continued)

*Primary Examiner* — Jonathan Liu
*Assistant Examiner* — Devin K Barnett

(57) ABSTRACT

A hanger spacer tape device having a flexible elongated body and a plurality of bumps or protrusions formed on one side thereof. The hanger spacer tape device allows hangers to be spaced at intervals and stay aligned to provide effective and efficient organization of hangers and can be coiled onto itself.

2 Claims, 7 Drawing Sheets

(56) References Cited

U.S. PATENT DOCUMENTS 2,895,618 A * 7/1959 Nathan ..... A47F 7/24 211/123
2,969,881 A * 1/1961 Lilly ..... B60R 7/10 211/105.3
2,989,191 A * 6/1961 Eason ..... A47G 25/32 211/113
3,085,691 A * 4/1963 Smith ..... A47F 7/24 211/113
3,112,050 A * 11/1963 Eason ..... A47G 25/32 223/85
D201,735 S * 7/1965 Reich ..... 223/85
3,193,235 A * 7/1965 Jensen ..... A47G 25/1478 211/119.12
3,286,850 A * 11/1966 Ruhnke ..... A47B 61/003 211/105.1
3,384,244 A * 5/1968 Falek ..... A47B 61/003 16/87 R
3,464,588 A * 9/1969 Strike ..... A47G 25/1442 221/75
3,567,034 A * 3/1971 Mozelsio ..... A47G 25/0692 211/7
D247,085 S * 1/1978 Stoddard ..... D6/328
4,316,547 A * 2/1982 Varon ..... A47G 25/0692 211/105.1
4,351,441 A * 9/1982 Schramm ..... A47F 7/24 211/182
4,361,241 A * 11/1982 Stoddard ..... A47F 7/24 211/123
4,380,298 A * 4/1983 Harig ..... A47F 5/13 211/182
4,474,299 A * 10/1984 Andrews ..... A47F 7/24 211/123
4,498,938 A * 2/1985 Moisson ..... F16G 11/02 156/49
4,548,328 A * 10/1985 Brauning ..... A47F 7/24 211/123
4,655,354 A * 4/1987 Cohen ..... A47F 5/108 211/199
4,760,929 A * 8/1988 Fedorchak ..... A47B 61/003 211/105.1
4,770,303 A * 9/1988 Boyd ..... A47G 7/042 211/118
4,860,799 A * 8/1989 Van Noten ..... F16L 47/22 138/167
4,900,596 A * 2/1990 Peacock ..... B29C 53/36 138/110
4,960,213 A * 10/1990 Pfeifer ..... A47F 7/19 211/105.1
4,971,210 A * 11/1990 Blumenkranz ..... A47F 7/24 211/105.1
4,982,670 A * 1/1991 Zom ..... B65G 21/22 104/93
5,014,862 A * 5/1991 Bustos ..... A47F 5/103 211/189
5,018,627 A * 5/1991 Moore ..... A47F 7/24 206/291
D323,284 S * 1/1992 Thompson ..... D6/320
5,103,984 A * 4/1992 Leyden ..... A47F 5/0861 211/4
5,170,898 A * 12/1992 Katz ..... A47B 57/54 211/193
5,176,304 A * 1/1993 Palmer ..... B60R 7/10 211/123
D337,493 S * 7/1993 King ..... D8/380
5,300,732 A * 4/1994 Wambeke ..... B29C 61/10 138/128
5,386,916 A * 2/1995 Valiulis ..... A47F 5/0006 211/113
D361,444 S * 8/1995 Egan ..... D6/680.2
5,611,123 A * 3/1997 Prizzi ..... A47C 7/62 211/124
5,657,886 A * 8/1997 Tacchella ..... A47H 1/02 150/154
5,775,756 A * 7/1998 Rozenich ..... A63B 21/0724 16/421
6,112,909 A * 9/2000 Moseley ..... A47F 5/0807 211/30
6,153,277 A * 11/2000 Chang ..... B62J 1/18 16/430
D438,450 S * 3/2001 Jones ..... D8/376
D439,564 S * 3/2001 Huang ..... D13/153
6,196,399 B1 * 3/2001 Pacheco ..... A47G 25/1478 211/113
D486,583 S * 2/2004 Self ..... D25/41.1
6,758,351 B1 * 7/2004 Klingsdal ..... D06F 53/005 211/119.18
7,097,051 B2 * 8/2006 Schober ..... A47B 61/003 211/100
7,168,577 B1 * 1/2007 Moseley ..... A47F 7/06 211/32
7,703,179 B2 * 4/2010 Ferguson ..... A63B 53/14 16/431
8,292,135 B1 * 10/2012 Schorn ..... A47G 25/26 223/98
8,613,411 B1 * 12/2013 Mohns ..... F16L 3/1226 174/135
9,052,042 B2 * 6/2015 May ..... F16L 11/10
9,402,494 B1 * 8/2016 O'Brien ..... A47F 7/12
9,480,367 B2 * 11/2016 Reed ..... A47K 17/022
9,782,030 B1 * 10/2017 Bell ..... A47G 25/1471
9,784,415 B2 * 10/2017 Linge ..... F21K 2/00
D821,106 S * 6/2018 Jones ..... D6/328
10,021,975 B1 * 7/2018 Womble ..... A47B 61/02
10,076,195 B2 * 9/2018 Winikoff ..... A47F 5/0043
2002/0153337 A1 * 10/2002 Shuen ..... A47G 25/0692 211/123
2005/0082245 A1 * 4/2005 Arjomand ..... A47G 25/0692 211/125
2005/0230441 A1 * 10/2005 Presser ..... A47G 25/32 223/85
2006/0118505 A1 * 6/2006 Walter ..... A47F 5/08 211/190
2006/0278594 A1 * 12/2006 Macon ..... A47B 61/003 211/123
2007/0088402 A1 * 4/2007 Melvin ..... A61N 1/3785 607/35
2007/0241143 A1 * 10/2007 Box ..... A47G 25/183 223/85
2009/0020446 A1 * 1/2009 Frankenstein ..... B25H 3/04 206/373
2009/0256045 A1 * 10/2009 Tunberg ..... A47G 1/1686 248/339
2009/0283485 A1 * 11/2009 Anderson ..... A47F 7/06 211/85.3
2009/0289089 A1 * 11/2009 Fullerton ..... H01F 7/0215 224/183
2009/0289090 A1 * 11/2009 Fullerton ..... A45F 5/02 224/183
2010/0044403 A1 * 2/2010 Humphreys ..... B60R 7/10 223/88
2011/0288628 A1 * 11/2011 Noesner ..... A61F 2/07 623/1.15
2012/0198680 A1 * 8/2012 Durben ..... A47G 25/08 29/428
2015/0005869 A1 * 1/2015 Soletti ..... A61F 2/064 623/1.13
2016/0081519 A1 * 3/2016 Manko ..... A47K 10/04 211/16

* cited by examiner

HANGER SPACER TAPE

CROSS-REFERENCE TO RELATED APPLICATION

This application is a continuation of U.S. Non-Provisional application Ser. No. 16/051,438, filed on Jul. 31, 2018, the disclosure of which, including any materials incorporated by reference therein, are incorporated herein by reference in its entirety.

BACKGROUND OF THE INVENTION

The present invention generally relates to a hanger spacer device, more particularly to a hanger spacer tape device that can adhesively attach to a closet rod or pole. The hanger spacer tape is provided with a plurality of bumps or protrusions spaced at predetermined intervals allowing hangers to be spaced according to the predetermined spacing of the bumps or protrusions.

Closet organization has been a challenge to many, namely, to keep one's closet neat and organized so that articles of clothing can be readily found. One issue stems from the fact that there are many types of hangers that are available to consumers, such as wire, plastic and wooden with metal hook portions, to name a few. But even with the use of the same (or similar) hangers, a closet can oftentimes appear disorganized. Articles or clothing are necessarily shifted around, making the closet appear untidy, leaving items difficult to find. Organization of hanging items, however, is not necessarily unique to personal closets, and can also be a problem for clothing retail stores.

Attempts have been made to improve clothing organization, but each have notable drawbacks. Examples can be seen in U.S. Pat. Nos. 2,895,618, 4,361,241, 4,760,929, 4,960,213, 7,028,855, 9,782,040, and U.S. Patent Application Publication No. 2006/0278594, and U.S. Pat. No. D247,085, each incorporated by reference herein.

In contrast to the aforementioned publications, the hanger spacer device in accordance with the present invention is simple to install, has the ability to be used on a variety of surfaces and in various locations, low-profile and can be discreet. Specifically, the hanger spacer device in accordance with the present invention keeps hangers (and clothes thereon) aligned, spaced at predetermined intervals, giving the closet an overall organized, clean look. Another advantage provided by exemplary embodiments of the present invention is that one can sort and view articles of clothing without disrupting the spacing of other articles of clothing in the closet. Another advantage provided by exemplary embodiments of the present invention is that when an item is removed, the hanger remains in the same place, again, not disrupting the placement of the other items in the closet.

The present invention also allows users to single, double, or triple space (or more, as desired by the user) items easily thereby giving the user the ability to customize his/her closet in accordance with his/her wardrobe. For example, bulkier items such as jackets may require additional spacing. Protrusions can also be intentionally "skipped" to leave spaces to create separation between different categories of clothing, allowing for further organization of the closet. Sections can be created by skipping a series of spacing elements. Overall, the present invention allows a user of the device to customize and organize as the user sees fit. The spacing elements keep the hung items aligned, spaced evenly, and looking organized. Moreover, the low-profile appearance of the present invention does not further clutter the look of the closet.

With the present invention, clothes can still be moved in either direction to allow for adjustment according to a user's desires or preferences.

The present invention allows a user to customize the length of tape being needed to fit a variety of closet spaces (or other area, not limited to closets that may require similar organization). In other words, the present invention is efficient, functional, and has the ability make any closet (or other space) appear organized.

SUMMARY OF THE INVENTION

A hanger spacer device for keeping hangers spaced at predetermined intervals comprising a flexible elongated main body having a length and a width, wherein the length is longer than the width, the main body portion having a top surface and a bottom surface, wherein the flexible elongated main body portion is flexible both lengthwise and widthwise.

The hanger spacer device also comprises a plurality of protrusions comprising adjacent pairs of protrusions formed on the top surface of the flexible elongated main body, wherein the protrusions are spaced at regular intervals.

The hanger spacer device also has hanger spaces formed between each adjacent pair of protrusions, wherein a hanger can be placed in each hanger space respectively.

The hanger spacer device an adhesive provided along the bottom surface of the flexible elongated main body, wherein the hanger spacer device is configured to be mounted to a rod. The hanger spacer device can also have an elongated main body movable between a mounting position wherein the main body can become arcuate in shape to conform to an upper surface of the rod and a storage position wherein the main body can be coiled onto itself along the length of the main body in a multilayered overlapping manner.

BRIEF DESCRIPTION OF THE DRAWINGS

A more complete understanding of the present invention may be obtained with reference to the Detailed Description when taken in conjunction with the accompanying Drawings.

DETAILED DESCRIPTION OF THE INVENTION

Figure 1A:
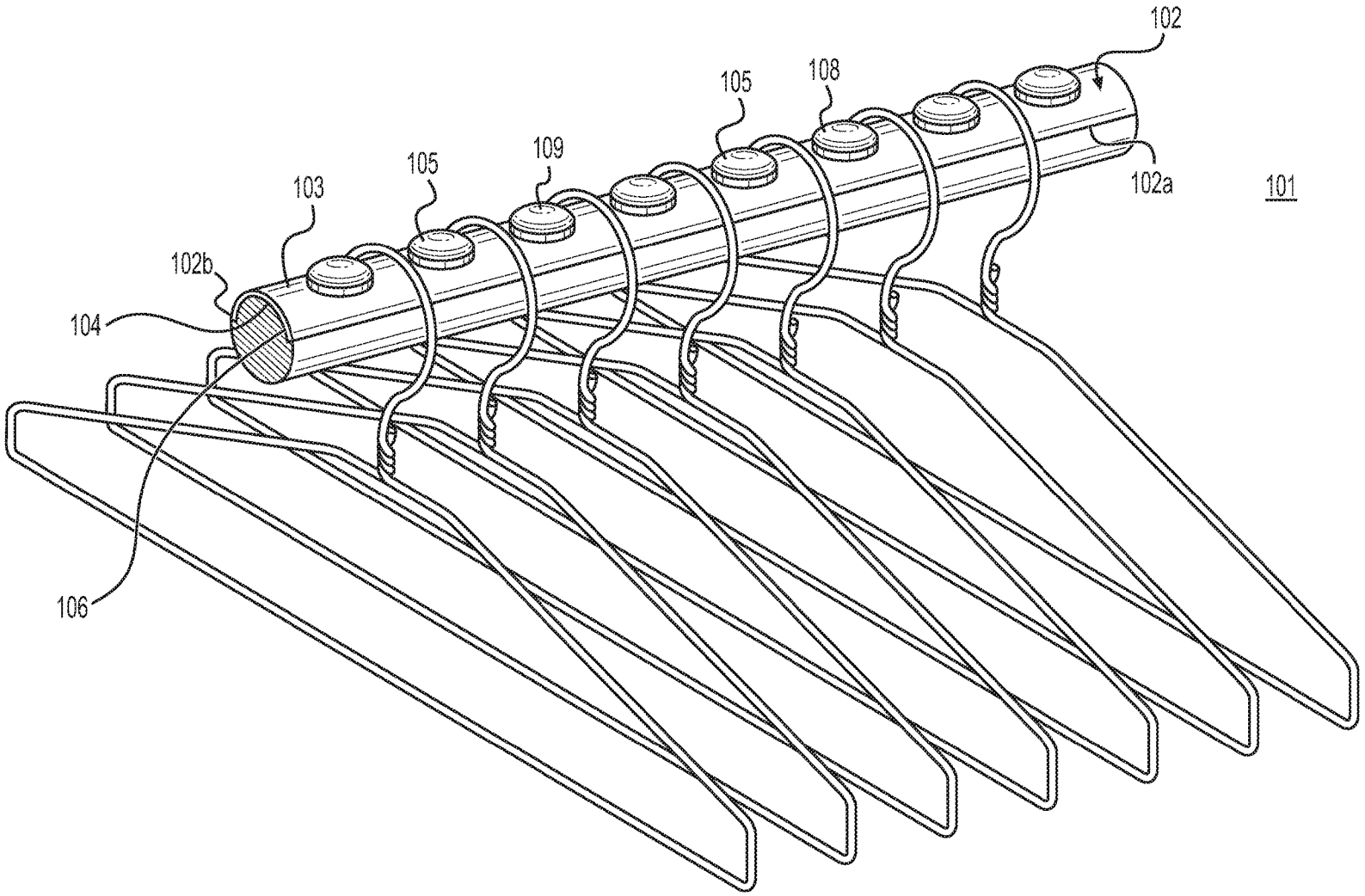
FIG. 1A is a perspective view of the hanger spacer tape in accordance with one aspect of the present invention.
Figure 1B:
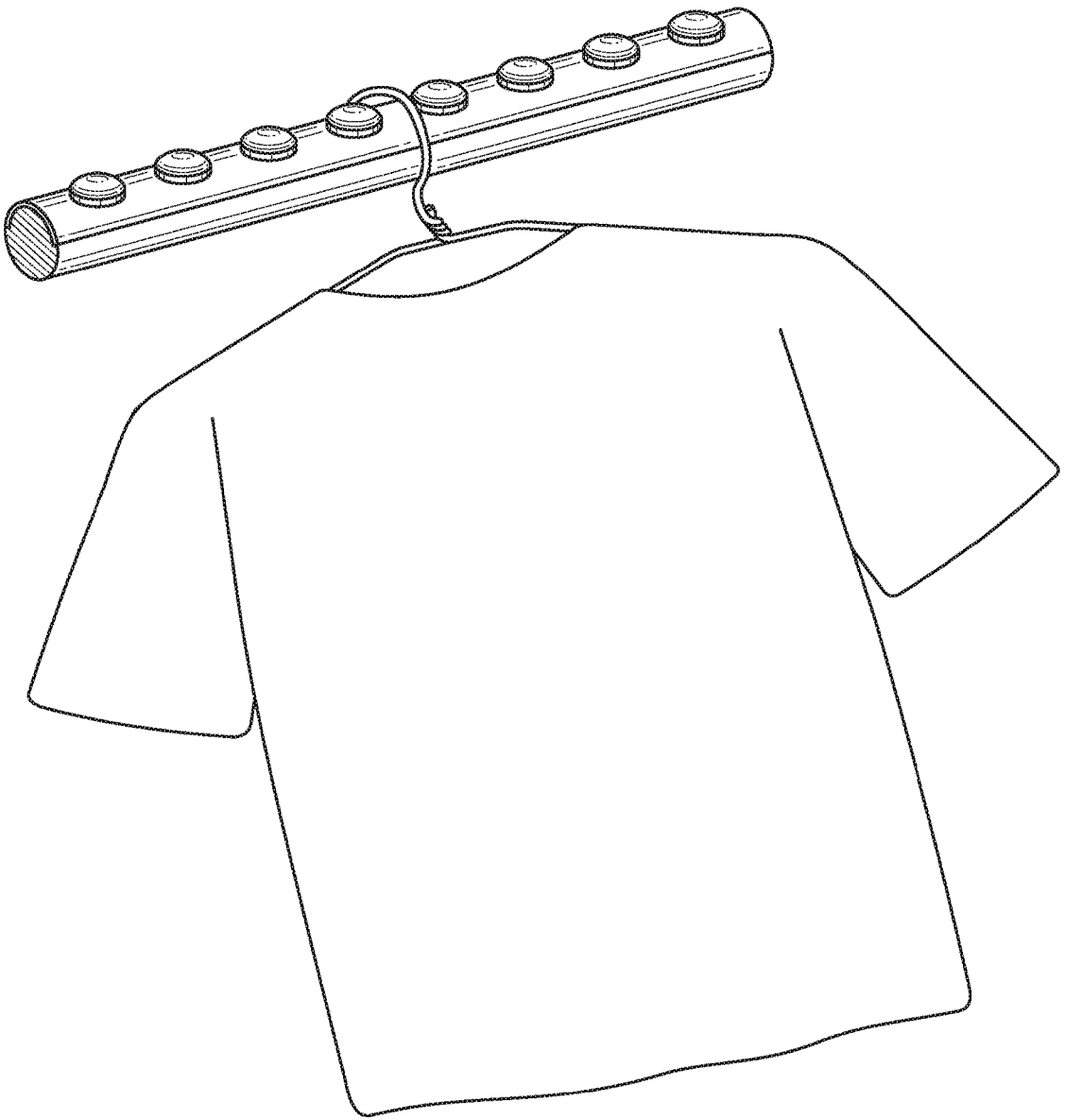
FIG. 1B is a perspective view of the hanger spacer device of FIG. 1A showing how a hanger can pivot 45 degrees on the device.

Referring now to FIG. 1, a top view of one exemplary embodiment of the hanger spacer device 101 is shown.

Hanger spacer device 101 has a flexible elongated main body 102 with left and right edges 102*a* and 102*b* a top surface 103 and a bottom surface 104. Flexible elongated main body 102 is flexible both lengthwise and widthwise such that it can readily conform to surfaces of varying shapes, such as a rod or pole as shown in FIG. 1. Flexible elongated main body 102 can be in the form of a tape. The length of flexible elongated main body 102 is greater than the width of flexible elongated main body 102.

Formed on top surface 103 of the hanger spacer device 101 is a plurality of protrusions or bumps 105. The protrusions or bumps 105 are generally semispherical in shape. Provided on bottom surface 104 of the hanger spacer device 101 is an adhesive 106 that allows the hanger spacer device to stay adhered to the pole or rod. Adhesive 106 can be a glue or other substance that keeps hanger spacer device in place. Adhesive 106 can be one which can adhere to a number or materials that are commonly used to construct closet rods or poles, such as wood, plastic and metal.

Figure 2A:
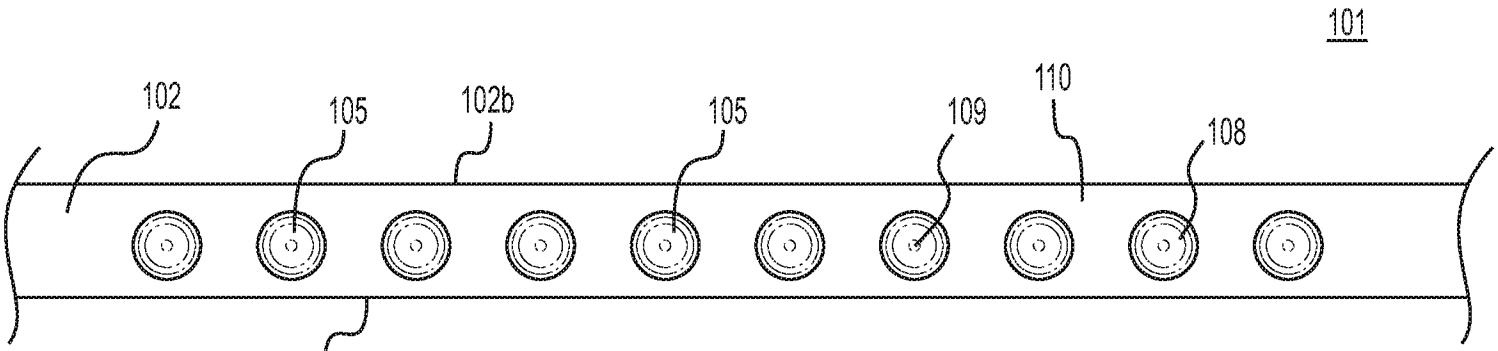
FIG. 2A is a top view of the hanger spacer tape of FIG. 1A and 1B.
Figure 2B:
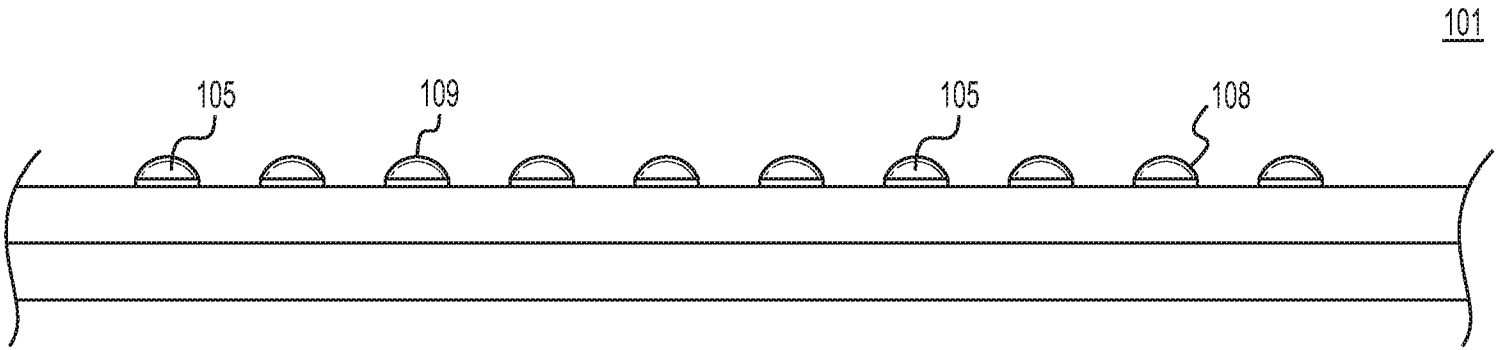
FIG. 2B is a side view of the hanger spacer tape of FIG. 2A.

In the exemplary embodiment seen in FIG. 2A and 2B, protrusions or bumps 105 have a rim 107 that has a circumference or rim perpendicular to top surface 103 of hanger spacer device 101 when not adhered to a rounded pole or other rounded surface. Protrusions or bumps further have a rounded top 108.

Each protrusion or bump has a center 109 of rounded top 108. An ideal distance between each center 109 of the plurality of protrusions 105 has been found to be approximately ¾ inch. An ideal width of each protrusion 105 has been found to be approximately ⅜ inch. An ideal space between each of a pair of plurality of protrusions has been found to be approximately ⅜ inch. The specified spacing allows a variety of types of hangers (metal, plastic, wooden, etc.) that have varying widths to be placed between a pair or protrusions or bumps while maintaining adequate spacing between articles of clothing. The semispheric shape of the protrusions 105 allows hangers with the clothing to be turned so that a user can view the clothing item without disturbing other pieces. This can be seen in FIG. 1B. As the protrusions 105 do not extend to side edges 102*a* and 102*b* of flexible elongated main body 102, the hangers are able to pivot at least 45 degrees. The semispherical shape of the protrusions 105 also allows a hanger to slide down into space 110 in between the protrusions in the event a user places a hanger on top of the protrusion.

Moreover, in the event that bulkier articles of clothing, such as jackets, are being hung on hanger spacer tape 101, hangers can be place in every other (or every third) recess between the protrusions, creating equal spacing between those articles of clothing to achieve a clean, organized appearance. The hanger spacer tape device 102 also allows hung clothing to be pushed in either direction (like an accordion) for a user to view a selected piece of hung clothing. When the selected piece is released, the remaining pieces of clothing fall back into their original positions.

Figure 2C:
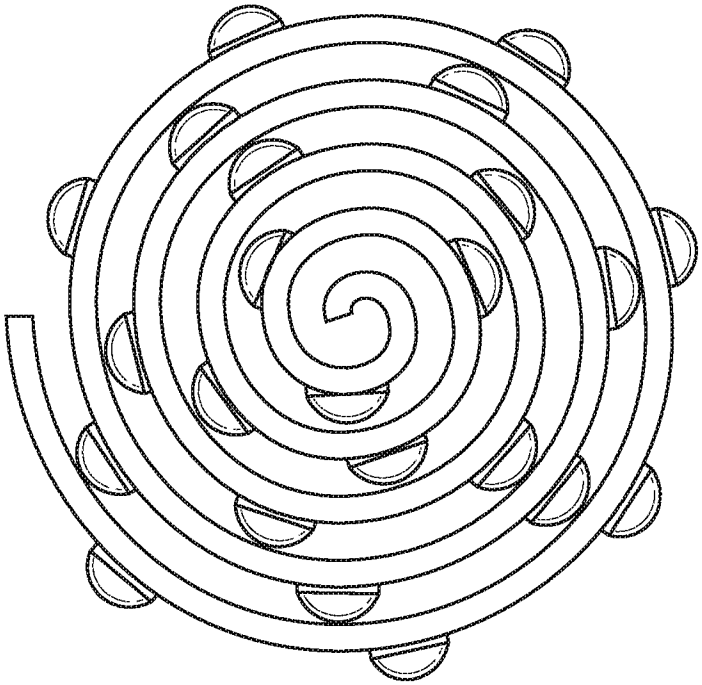
FIG. 2C is a perspective view of the hanger spacer device rolled or coiled up.

The hanger spacer tape device 102 can also be rolled or coiled onto itself as can be seen in FIG. 2C.

Figure 3A:
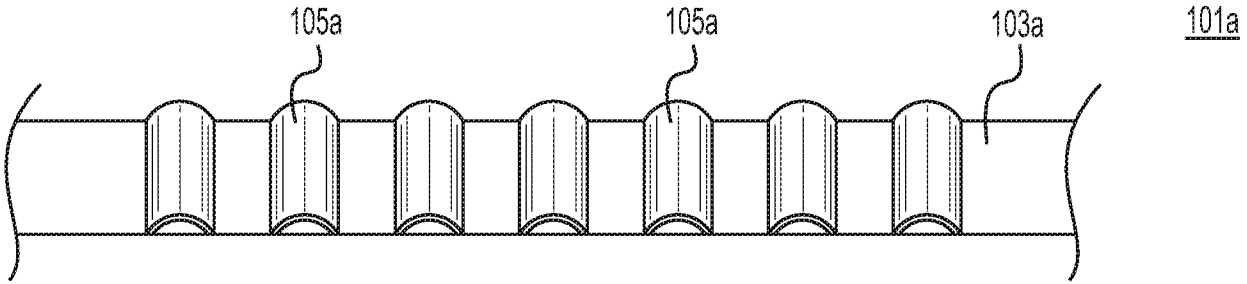
FIG. 3A is a top view of the hanger spacer tape in accordance with a second aspect of the present invention.
Figure 3B:
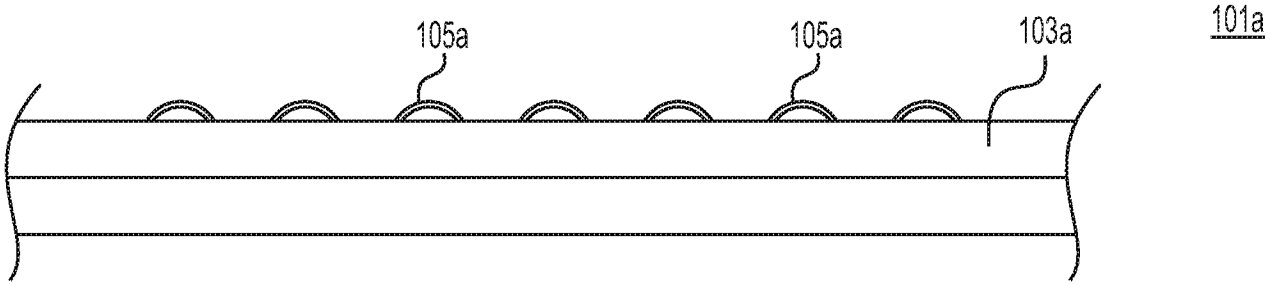
FIG. 3B is a side view of the hanger spacer tape of FIG. 3A.

An alternate embodiment is shown in FIGS. 3A & 3B, in which hanger spacer device 101*a* has a plurality of protrusions 105*a* shaped as half cylinders.

The hanger spacer tape device can also be used in other places, such as on a curtain rod or shower curtain and can be used in a number of environments outside of a household closet, such as in a garage, storage unit, attic, basement, laundry room or even a car. The hanger spacer tape device could be particularly useful in retail stores where clothing should appear organized and visible to customers.

While other shapes (such as rectangular, square, triangles, stars, hearts, circles with flat tops and trapezoids) can be used, the embodiment described herein provides certain benefits to maximize ease of use.

The flexible elongated main body can vary in thicknesses but should maintain a thickness that allows the main body to easily form around a rounded body such as a rod or pole.

While the foregoing written description of the invention enables one of ordinary skill in the art to make and use the invention, those of ordinary skill in the art will understand and appreciate the existence of variations, combination, and equivalents of the embodiments, methods, and examples provided herein. The invention should, therefore, not be limited by the embodiments and examples disclosed here, but by all embodiments and methods within the scope and spirit of the invention as claimed.

The invention claimed is:

1. A hanger spacer device for keeping hangers spaced at predetermined intervals comprising:

a flexible elongated main body having a length and a width, wherein said length is longer than said width, said flexible elongated main body having a top surface and a bottom surface, wherein said flexible elongated main body is flexible both lengthwise and width wise;

a plurality of protrusions comprising adjacent pairs of protrusions formed on said top surface of said flexible elongated main body, wherein said protrusions are spaced apart at regular intervals;

hanger spaces formed between each adjacent pair of protrusions, wherein a hanger can be placed in each hanger space respectively; and an adhesive provided along said bottom surface of said flexible elongated main body;

wherein the hanger spacer device is configured to be mounted to a rod;

wherein the elongated main body moves between a mounting position wherein the main body is arcuate in shape to conform to an upper surface of the rod and a storage position wherein the main body is coiled onto itself along the length of the main body in a multilayered overlapping manner.

2. A hanger spacer device for keeping hangers spaced at predetermined intervals comprising:

a flexible elongated main body having a length and a width, wherein said length is longer than said width, said flexible elongated main body having a top surface and a bottom surface, wherein said flexible elongated main body is flexible both lengthwise and widthwise;

a plurality of protrusions comprising adjacent pairs of protrusions formed on said top surface of said flexible elongated main body, wherein said protrusions are spaced apart at regular intervals;

hanger spaces formed between each adjacent pair of protrusions, wherein a hanger can be placed in each hanger space respectively; and wherein the hanger spacer device is configured to be mounted to a rod;

wherein the elongated main body moves between a mounting position wherein the main body is arcuate in shape to conform to an upper surface of the rod and a storage position wherein the main body is coiled onto itself along the length of the main body in a multilayered overlapping manner.

* * * * *